US005750057A

United States Patent [19]

Brown et al.

[11] Patent Number: 5,750,057

[45] Date of Patent: May 12, 1998

[54] INSENSITIVE BINARY EXPLOSIVE PRODUCTION PROCESS

[75] Inventors: Jerry S. Brown, Woodford, Va.; John A. Conkling, Chestertown, Md.

[73] Assignee: The United States of America as represented by the Secretary of the Navy, Washington, D.C.

[21] Appl. No.: 869,724

[22] Filed: Jun. 5, 1997

Related U.S. Application Data

[62] Division of Ser. No. 622,174, Feb. 28, 1996.

[51] Int. Cl.[6] ..... C06B 21/00

[52] U.S. Cl. ..... 264/3.2; 264/3.4; 149/109.6

[58] Field of Search ..... 264/3.2, 3.4; 149/109.6

[56] References Cited

U.S. PATENT DOCUMENTS

| | | | |
|---|---|---|---|
| 2,721,792 | 10/1955 | Hannum | 52/5 |
| 3,986,906 | 10/1976 | Sayles | 149/19.4 |
| 4,253,889 | 3/1981 | Maes | 149/47 |
| 4,919,737 | 4/1990 | Biddle et al. | 149/19.5 |
| 5,011,503 | 4/1991 | Buxton | 44/322 |
| 5,226,986 | 7/1993 | Hansen et al. | 149/109 |
| 5,578,789 | 11/1996 | Oberth | 149/19.9 |
| 5,641,938 | 6/1997 | Holland et al. | 149/48 |

*Primary Examiner*—Peter A. Nelson
*Attorney, Agent, or Firm*—James B. Bechtel, Esq.

[57] ABSTRACT

The present invention provides a multi-component explosive composition comprising 2-ethylhexyl nitrate and a granular solid oxidizer. An optional additional component is a second fuel, e.g., aluminum. An optional component in the absence of the second fuel is azodicarbonamide. Methods for making the explosive are provided.

8 Claims, No Drawings

INSENSITIVE BINARY EXPLOSIVE PRODUCTION PROCESS

This is a divisional of application Ser. No. 08/622,174 filed on Feb. 28, 1996, pending Dec. 21, 1997.

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The present invention relates to the field of explosive compositions, and methods of making and using same. More particularly, this invention relates to a two component explosive composition.

BACKGROUND OF THE INVENTION

Federal and local regulations impart a significant cost burden on the storage, shipment, and handling of explosives. For example, explosives which are cap-sensitive require special handling pursuant to regulations. The requirement for special handling increases the cost of such compositions. For many applications where non-bulk explosives are required, the use of a binary or multi-component explosive is desirable from both a cost and safety basis. A binary explosive composition is an explosive composition produced by the mixture of two components just prior to use and for which each component is non-detonable under normal industrial practices. Multi-component explosives are produced by admixture of more than two components just prior to use.

Present commercial binary or multi-component explosives are generally nitromethane based. Nitromethane, which has the chemical structure $CH_3NO_2$ is a fuel. The binary explosive is formulated with an oxidizer as the second component. See, for example, U.S. Pat. No. 3,718,512, which discloses a binary explosive containing ammonium nitrate and nitromethane. See also U.S. Pat. No. 2,721,792.

Another multi-component explosive composition includes a combination of a liquid component, itself a combination of non-self-reacting, halogenated hydrocarbons or amides, such as trichloroethane, trichloroethylene, perchloroethylene, percloroethane and formamide, with nitroaliphatic hydrocarbons, such as nitromethane, and a dry component such as ammonium nitrate, alkali, alkaline or metal nitrates or perchlorates and ammonium perchlorate. [See U.S. Pat. No. 4,253,889].

Still other multi-component explosive compositions are described by U.S. Pat. No. 5,226,986 as containing aluminum fuel particles with an oxidizing liquid which is an aqueous solution of an oxidizing agent such as alkali metal, alkaline and ammonium nitrates, alkali metal, alkaline and ammonium perchlorates. Alternatively the liquid can be a nitromethane, nitroethane, nitropropane, or mixture thereof.

A disadvantage of all such explosive combinations is the expense and toxicity of the nitromethane and related components. Thus, there remains a need in the art for other binary or multi-component compositions which are safer to use and less costly than the present compositions containing nitromethane.

SUMMARY OF THE INVENTION

The invention provides a multi-component explosive composition which does not contain nitromethane, and which is characterized by lower volatility, lower toxicity and lower cost than presently available explosive compositions.

In one aspect, the composition comprises an admixture of:

(a) a high-boiling alkyl nitrate, in which the alkyl contains greater than 3 carbon atoms. A preferred alkyl nitrate is 2-ethylhexyl nitrate ($C_8H_{17}NO_3$); and (b) a second component selected from a granular solid oxidizer selected from the group consisting of alkali and alkaline earth metal nitrates, alkali and alkaline earth metal perchlorates, ammonium nitrate and ammonium perchlorate.

In another aspect, the invention provides an explosive composition as described above which further contains as an additional third component, a metal. One preferred metal is aluminum. Other metals may also be selected for this purpose, but care must be taken to select the appropriate oxidizer as the second component. For example, where the selected metal is magnesium, the oxidizer must not be acidic, like ammonium perchlorate. The selected oxidizer must be selected from among the alkaline oxidizers identified above.

In still a further aspect, the invention provides a multi-component explosive which contains, in addition to the high-boiling alkyl nitrate and oxidizer, the third component, azodicarbonamide (AzDCA).

In another aspect, the invention provides an improved multi-component explosive composition, which composition contains in place of any other nitro-aliphatic hydrocarbon, the compound 2-ethylhexyl nitrate.

Still further aspects of this invention concern methods of making and using the compositions of this invention.

Other aspects and advantages of the present invention are described further in the following detailed description of the preferred embodiments thereof.

DETAILED DESCRIPTION OF THE INVENTION

The present invention provides a binary explosive composition consisting of at least two components: a liquid high-boiling alkyl nitrate such as 2-ethylhexyl nitrate, and a dry granular solid component which is an oxidizer. This oxidizer may be one conventionally employed in known explosive compositions with nitromethane. Optional additional components, e.g., AzDCA or a selected metal, may be added to the binary composition above to provide a multi-component explosive composition with enhanced sensitivity or performance.

Each component of the composition of the invention is individually non-detonable, i.e., not classified as an explosive. Because these separate components are not classified as explosives, they can be handled, shipped, and stored as either oxidizers or flammable materials. These latter classifications are more easily and less expensively shipped than explosives. However, these components, when mixed, form a cap-sensitive explosive. The term "cap-sensitive" is defined herein as sensitive to detonation by a No. 8 test blasting cap when the explosive is unconfined.

A significant advantage of this composition is the reduced cost/logistics burden of transportation, storage, and handling of these component materials, which are not classified as explosives until the individual components are mixed on site.

The first component is a high-boiling alkyl nitrate, i.e., a nitroaliphatic hydrocarbon. The preferred compound is 2-ethylhexyl nitrate (EHN), which has a chemical formula $CH_3(CH_2)_3CH(C_2H_5)CH_2ONO_2$. The 2-ethylhexyl nitrate is a low viscosity liquid fuel at atmospheric pressure, with an oxygen balance of −197% available oxygen. By "oxygen balance" is meant the amount of oxygen, expressed in percent by weight, liberated in the complete conversion of the energetic material to $CO_2$, $H_2O$, etc. EHN is normally used as a diesel fuel additive to adjust the octane rating. This molecule possesses the unique combination of a strong fuel ($C_8H_7$- structure) and the addition of an energetic nitrate radical (—$ONO_2$). This liquid component can be stored and transferred in interstate commerce without having to meet explosive regulations, because it is non-detonable.

Other advantages of EHN are its low vapor pressure, high flash point, relatively low toxicity (as compared to nitromethane), and low cost. A comparison of these properties with nitromethane, the alternative fuel generally used in commercial binary explosives is demonstrated in Table I below.

TABLE I

COMPARISON OF EHN AND NITROMETHANE

| | EHN | Nitromethane |
|---|---|---|
| Vapor pressure, mm Hg @ 20° C. | 0.2 | 27.8 |
| Flash point, °C.* closed cup | 80 | 35 |
| Toxicity - ingestion, $LD_{50}$, mg/kg (rat) | 79,600 | 940 |
| Relative cost, $ | 1.00 | 1.80 |

*A flammable liquid is defined by the Department of Transportation as a liquid with a flash point below 38° C.

The second component of the composition of this invention is dry component, which is an oxidizing compound, preferably a granular solid oxidizer. Examples of useful oxidizers are alkali earth metal nitrates such as sodium or potassium nitrates, or alkaline earth metal nitrates, such as barium or calcium nitrates; alkali earth metal perchlorates, such as sodium or potassium perchlorates, or alkaline earth metal perchlorates, such as barium or calcium perchlorates, or ammonium nitrate or ammonium perchlorate. The preferred oxidizers are ammonium perchlorate, ammonium nitrate and sodium nitrate. This second component may be readily selected from among oxidizers conventionally used in the manufacture of explosive compositions to achieve desired properties in energetic formulations. These compounds are similarly non-detonable under shipping conditions.

These components may be packaged in separate containers conventionally employed for the desired purpose, e.g., the liquid EHN in a metal can or glass container, and the dry component in paper or plastic bags. A mixing container is preferably provided which has sufficient volume to allow for mixing of the components in an appropriate ratio, leaving sufficient free volume in the container to assist in uniform mixing or shaking.

Mixing of these dry and liquid components to produce the composition of the present invention can thus be accomplished just prior to the need for the explosive composition. Mixing of the components can be accomplished without mechanical agitation. A preferred mixing technique is hand-mixing in a suitable container. This means that a motor-driven mixer is not required. However, as with most chemicals, one should not physically handle the chemicals, themselves.

In the mixture, the EHN is present in a sufficient stoichiometric amount with respect to the dry oxidizer to allow the EHN to react with all of the oxidizer. The stoichiometric amounts of these reactants are generally dependent upon their respective chemical structures. Practically, the mixture can vary between about 5 to 10%. By adding too much of one reactant, i.e., more than the stoichiometric amount, the mixture is diluted with material that will be unreacted and this will degrade the performance of the explosive. The desired size of the explosion is a function of the amount of the stoichiometric mixture rather than one component. The EHN in the explosive mixture is desirably present in an amount ranging from 14.0±10% by weight based on the total weight of the composition and the oxidizer is present in amounts of 86%±10% by weight based on the total weight of the composition.

At the site of use, a measured amount of EHN and the dry oxidizer are mixed. The two components are mixed together, as described above, until the resulting mixture has a consistency of damp sand. In this condition, the composition may be packed in cartridges or other pre-formed containers, or poured into drill holes. This explosive composition is thus useful for mining, quarries, road and building construction, as well as in well drilling, especially for blasting laterally using shaped charges. The cartridges can be pre-formed to produced a shaped charge.

In another embodiment of the multi-component explosive composition of this invention, the composition may contain, in addition to the two components identified above, a third component. This third component may be an additional fuel, such as aluminum powder. Aluminum flake powder with a particle size between 7 and 8 micrometers is a conventionally used fuel with an oxygen balance of −89% available oxygen. The aluminum is added for enhanced thermal output. Other powdered metals are anticipated to work similarly. For example, magnesium may be employed in place of aluminum, but only with a non-acidic oxidizer, such as potassium perchlorate. Magnesium could not be employed with acidic oxidizers such as ammonium perchlorate or ammonium nitrate, for example. Such a third component is desirably admixed with the liquid EHN prior to transportation. This mixture is, like liquid EHN itself, non-detonable, and may be packaged similarly to EHN itself. This liquid mixture is mixed with the oxidizer on site to produce the explosive, as described above for EHN and an oxidizer alone.

In an exemplary embodiment of this composition, when ammonium perchlorate (AP) is the oxidizer and EHN and Al are employed as the two fuels, the fuels are added to react with all of the ammonium perchlorate. The ratios of the two fuels can be varied and each ratio will affect the amount of ammonium perchlorate required for a stoichiometric mix, as illustrated in the Table II below:

TABLE II

| | Stoich mix, % by wt | Possible stoich. ranges, % by wt |
|---|---|---|
| AP | 80.70 | 86–72 |
| EHN | 9.65 | 14–0 |
| Al | 9.65 | 0–28 |

Another embodiment of an explosive composition of this invention employs the liquid high-boiling alkyl nitrate, e.g., EHN, the dry oxidizer, and azodicarbonamide (AzDCA). AzDCA has the chemical formula $H_2NCONNCONH_2$, and is a nontoxic yellow solid normally used as a blowing agent for plastics and rubbers and as a maturing agent for flours. AzDCA can be used to vary the sensitivity of the combined binary explosive to achieve the most desirable properties for handling the combined product as well as ease of detonation.

However, AzDCA is less effective when employed in the composition when aluminum or another metal fuel is used, such as the composition described above.

AzDCA as an additional component of an explosive composition of this invention is desirably admixed with the liquid EHN prior to transportation. This admixture is, like liquid EHN itself, non-detonable, and may be packaged similarly to EHN itself. Preferably the EHN is admixed with the minimum amount of AzDCA that desensitizes the mixture. For example, a discussed below and reported in Table VII, 5.0% by weight AzDCA in the explosive mixture containing ammonium perchlorate and 2-ethylhexyl nitrate (AP/EHN) produces the most insensitivity, or desensitization. Tests have shown that 2.5% by weight AzDCA is almost as insensitive. Therefore the lower of the two amounts is preferred.

The presence of an additional component does not alter the mixing or packaging guidelines supplied above. In each instance the resulting damp sand consistency of the explosive composition provides the advantages previously mentioned.

The following examples illustrate embodiments and advantages of the above-described invention. These examples do not limit the scope of the present invention.

EXAMPLE 1

A Binary Explosive Composition

One exemplary binary explosive composition of this invention is provided by admixing the components of Table III.

TABLE III

EXPLOSIVE COMPOSITION

| Component | % by weight |
|---|---|
| Ammonium perchlorate (AP) | 80.70 |
| 2-Ethylhexyl nitrate (EHN) | 9.65 |
| Aluminum (Al) | 9.65 |
| | 100.0 |

First, the liquid EHN [Aldrich Chemical Company, Milwaukee, Wis. or Imperial Chemical Industries, Ltd., Ayrshire, Scotland] was admixed with aluminum flake powder [Reynolds Metal, Louisville, Ky.] with a particle size between 7 and 8 μm. These two components are introduced into a suitable container and the container is shaken to permit a substantially homogenous mixture.

Thereafter, ammonium perchlorate, which has the chemical formula $NH_4ClO_4$, and which conforms to MIL-A-192B, Grade C, Class 8 with a particle size of 90 μm, was introduced into the container. AP was obtained from a commonly available source [Kerr-McGee Chemical Corp, Oklahoma City, Okla.]. This compound is an oxidizer characterized by an oxygen balance of +34% available oxygen. Oxygen balance is the amount of oxygen, expressed in percent by weight, liberated in the complete conversion of the energetic material to $CO_2$, $H_2O$, $Al_2O_3$, etc. The above composition of Table III is a stoichiometric formulation which permits a stoichiometric reaction between all three components.

The mixture is mixed to substantial homogeneity. The consistency of the resulting composition is that of damp sand.

EXAMPLE 2

Characteristics of the Invention

A. Overpressure vs. Distance Characteristics

This example demonstrates that the multi-component explosive composition of Example 1 exhibits excellent overpressure vs distance characteristics in open air tests as compared to an emulsion explosive control and to two other commercial explosives, which exhibit fast detonation velocities. EMUTRENCH™ explosive (Austin Powder, Cleveland, Ohio) is an emulsion explosive used as the control. PRIMASHEET™ explosive (North American Explosives, Simsbury, Conn.) is a 63% PETN sheet explosive, used in these tests for comparison. SX2™ explosive (North American Explosives) is an 88.2% hexahydro-1,3,5-trinitro-1,3,5-triazine (RDX) detonating cord. Twenty five grams of each explosive were used for these tests.

The % control of the above-identified explosive compositions were calculated and reported in Table IV below. As an example, 2 psi overpressure was measured at 7 ft for the control and 2 psi overpressure was measured at 14 ft for an explosive composition; that is, a 2 psi overpressure at 7 feet would be 100% of the control (100%×7=7). A 2 psi overpressure at 14 feet would therefore be 200% of the control (200%×7=14).

TABLE IV

Overpressure vs. Distance

| Explosives | % Control |
|---|---|
| Composition of Example 1 | 200 |
| Primasheet 1000 | 200 |
| SX-2 | >200 |

Although it has not been measured directly, the compositions of this invention are anticipated to have high detonation velocities, due to high overpressure vs. distance measurements, as above.

B. Impact Sensitivity

Impact sensitivity was performed on the composition of Example 1 (i.e., AP/EHN/Al) and other formulations of the explosive according to this invention, as well as to combinations of components which do not form explosive compositions of this invention. The compositions according to this invention were the composition of Example 1 and AP/EHN. Control compositions were EHN/Al, and AP alone. The impact sensitivity was measured using a FLM Device, a Bureau of Explosives comparable-type testing apparatus, which consists of an 8 pound weight dropped from various heights on a 10 milligram sample.

Results, which are reported in Table V below, are shown as the number of positive trials/total number of trials. A positive trial (sensitive sample) is indicated by a flash, report, or combination of the two. A sample with a positive reaction at four inches for 50% of the trials is considered too sensitive for transport.

TABLE V

Impact Sensitivity

| Height | Explosive Compositions | | | | |
|---|---|---|---|---|---|
| in in. | AP/EHN/Al | AP/EHN | AP/Al | EHN/Al | AP |
| 4 | 3/3 | 3/3 | 0/1 | — | — |
| 10 | 1/1 | — | 0/1 | — | — |

TABLE V-continued

| Height | Impact Sensitivity Explosive Compositions | | | | |
|---|---|---|---|---|---|
| in in. | AP/EHN/Al | AP/EHN | AP/Al | EHN/Al | AP |
| 15 | 1/1 | — | — | — | — |
| 20 | 1/1 | — | — | — | — |
| 25 | 1/1 | 1/1 | 1/1 | 0/3 | 0/3 |

The combined mix in the Composition of Example 1, i.e., AP/EHN/Al and a mixture of just the AP/EHN, were found to be impact sensitive. The AP/Al, the EHN/Al, and the AP alone were found to be impact insensitive.

EXAMPLE 3

Binary Explosive Composition

Another binary composition according to this invention is provided by the stoichiometric combination of just the AP and the EHN as shown below in Table VI.

The EHN was introduced into a suitable container and thereafter, ammonium perchlorate was introduced into the container. The mixture is mixed as described above to substantial homogeneity. The consistency of the resulting composition is that of damp sand.

TABLE VI

| Explosive Composition | |
|---|---|
| Component | % by weight |
| AP | 86.0 |
| EHN | 14.0 |
| | 100.0 |

This composition of Table VI exhibited an overpressure vs distance of 150% of the control, as shown in Table IV. This composition was found to be insensitive to static electricity as tested. For example, in two trial experiments, this composition exhibited no ignition at 613 millijoules.

As noted in Table V above, the AP/EHN combination is fairly shock sensitive. However, it was unexpectedly found that the addition of a small amount of azodicarbonamide (AzDCA) could make the AP/EHN composition shock insensitive (see Table VII below). By "small amount" is meant the minimum amount necessary which can range from about 1% by weight to about 8% by weight AzDCA. The table below illustrates embodiments of these compositions with a range of AzDCA of between about 2.5 to 5.0 by weight of the total weight of the composition. Another exemplary composition of this type contains about 13.3% by weight EHN, about 4.8% by weight AzDCA and about 81.9% by weight AP.

TABLE VII

| Height | Impact Sensitivity Explosive Composition of Example 3 containing AzDCA in % by weight | | |
|---|---|---|---|
| in ft. | 0 | 2.5 | 5.0 |
| 4" | 0/3 | — | — |
| 10" | 3/3 | — | — |
| 15" | 2/3 | 0/3 | — |
| 20" | — | 0/3 | — |
| 25" | — | 2/3 | 0/3 |

The overpressure vs distance for the explosive composition of Example 3 with the 5% addition of AzDCA was 125% of the control. This composition was also insensitive to static electricity, i.e., it demonstrated no ignition at 613 millijoules.

Numerous modifications and variations of the present invention are included in the above-identified specification and are expected to be obvious to one of skill in the art. Such modifications and alterations to the compositions and processes of the present invention are believed to be encompassed in the scope of the claims appended hereto.

What is claimed is:

1. A method of preparing an explosive from a two component explosive composition comprising admixing 2-ethylhexyl nitrate and a granular solid oxidizer and mixing the two components together in a container until a uniform mixture of a damp sand consistency is reached.

2. The method according to claim 1 further comprising packing preformed cartridges or containers with said composition.

3. The method according to claim 1 wherein said oxidizer is selected from the group consisting of alkali and alkaline earth metal nitrates, alkali and alkaline earth metal perchlorates, ammonium nitrate and ammonium perchlorate.

4. The method according to claim 1 where said composition contains no nitromethane.

5. The method according to claim 1 wherein said composition further comprises a second fuel admixed with said 2-ethylhexyl nitrate.

6. The method according to claim 5 wherein said second fuel is aluminum.

7. The method according to claim 5 wherein said second fuel is magnesium, and said oxidizer is alkaline.

8. The method according to claim 1 wherein said composition further comprises azodicarbonamide.

* * * * *